United States Patent [19]

Cavagna

[11] Patent Number: 4,540,394

[45] Date of Patent: Sep. 10, 1985

[54] LOCK AND/OR RELEASE SYSTEMS, ASSOCIATED IN STRUCTURE AND OPERATION TO THE RESTS OF CIRCULAR BLADES OR CREASERS, FOR CUTTERS OR CREASING MACHINES TO BE USED INDUSTRIALLY IN THE FIELD OF THE PAPER AND CARDBOARD MANUFACTURING

[75] Inventor: Elio Cavagna, S. Zenone al Lambro, Italy

[73] Assignee: Elio Cavagna S.R.L., S. Zenone al Lambro, Italy

[21] Appl. No.: 462,880

[22] Filed: Feb. 1, 1983

[30] Foreign Application Priority Data

Feb. 4, 1982 [IT] Italy ..... 19461 A/82

[51] Int. Cl.[3] ..... B31F 1/08

[52] U.S. Cl. ..... 493/365; 493/60; 493/479; 83/499; 83/504

[58] Field of Search ..... 83/498, 499, 504, 425.4; 493/34, 478, 479, 60, 367, 365, 366

[56] References Cited

U.S. PATENT DOCUMENTS 3,176,566 4/1965 Patterson, Jr. ..... 83/498

FOREIGN PATENT DOCUMENTS 1024341 2/1958 Fed. Rep. of Germany ..... 83/504

2072563 10/1981 United Kingdom ..... 83/498

*Primary Examiner*—Daniel C. Crane

*Assistant Examiner*—David B. Jones

*Attorney, Agent, or Firm*—Collard, Roe & Galgano

[57] ABSTRACT

There is provided an improvement to the lock and/or release systems, associated in structure and operation to the rests of circular blades or creasers, for cutters or creasing machines to be used in the field of paper and cardboard manufacturing, comprising in a structural operative unit, which includes at least a rest co-operating with sliding and traverse means, guides for the traverse of each unit along a bearing beam, each unit comprising at least a circular blade or creaser and additionally including a lowering and lifting device for the blade or creaser and selective lock or release device for said rest on the beam, wherein the lowering and lifting device and lock or release device are coordinated and synchronized in such a way that the lowering and lifting movements coincide with the activation of the lock and, respectively, the release thereof.

15 Claims, 2 Drawing Figures

Figure 1:
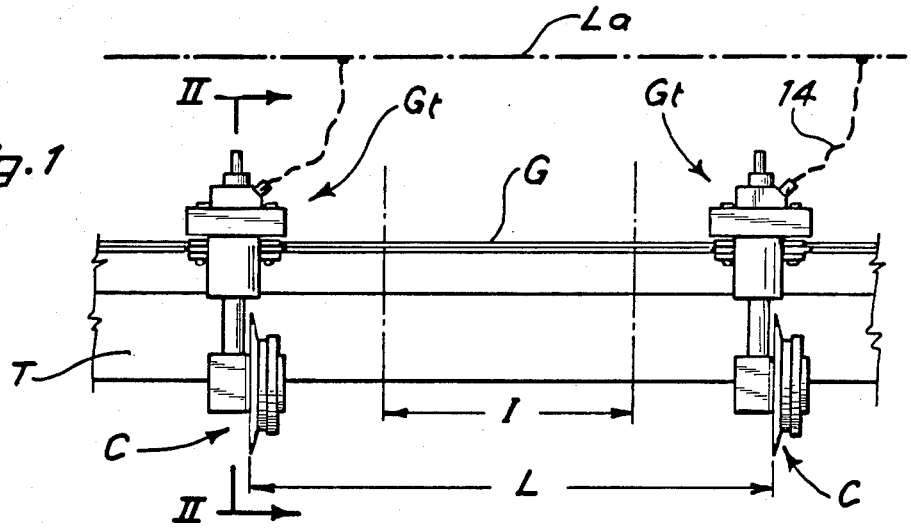

LOCK AND/OR RELEASE SYSTEMS, ASSOCIATED IN STRUCTURE AND OPERATION TO THE RESTS OF CIRCULAR BLADES OR CREASERS, FOR CUTTERS OR CREASING MACHINES TO BE USED INDUSTRIALLY IN THE FIELD OF THE PAPER AND CARDBOARD MANUFACTURING

DESCRIPTION

The present invention concerns an improvement to the lock and/or release systems, and more precisely self-lock and, respectively, self-release systems, associated with the rest means of the blades as well as of the circular creasers, particularly for cutters and creasing machines of the type to be used in the field of paper and cardboard manufacturing. This equipment is well known in the art.

In this known technique, the blade or blades are lowered and lifted through the selective and controlled action resulting from the counteracting of an elastic means, such as a spring, and of a pneumatic pressure fed through suitable pipes.

These devices are characterized, among other things, by the fact that the regulation mechanism (in practice) of the influx and defluxion of compressed air comprises a small valve of self-regulation put on the passing of the air, said valve opposing itself in a different way to the passing of the air, and therefore having a differentiated manner towards the air of delivery and that of return.

According to another known technique, there are used circuit means or pneumatic lines necessarily different and parted to control selectively the lowering and lifting movements of the circular blades or creasers and, respectively, the lock of the cutting or creasing assemblies in the prescribed work position along the guides of the beams bearing the very assemblies.

Since, notoriously, these cutting or creasing assemblies and the corresponding rests unavoidably exist in large number in the equipment, the duplication of the pipes, flexible and not, considerably increases the costs, in setting up and utilizing the equipment. Besides, lock systems are known which are controlled by hand, for instance by means of screws, improved by the adoption of pneumatic but not self-locking systems.

It is obvious that for positioning the cutting or creasing assemblies, particularly for changing the measures of the cuts or creases, with the known means, except the pneumatic systems (but as already said not self-locking), notable "idle times", according to a well-known expression in the art, take place.

That being stated, the purpose of the present invention is to remove the inconveniences resulting from the known traditional locks by hand, generally with screws, i.e. to reduce said idle times, as well as to remedy the technical and/or constructive limitations resulting from the duplication of the circuit systems of operation and of locking always the cutting blades or creasers.

The system, according to the invention, is materialized in a structural operative unit, including a rest cooperating with sliding and traverse means along a bearing beam, lowering and lifting means for the circular blade or creaser, and selective lock or release means for said rest on the beam, or better said guides; this system is characterized by the fact that it is coordinated and organized in such a way that the lowering and lifting movements coincide with the activation of the lock and, respectively, release means. These essential conditions justify properly the word "self-locking" reported in the preliminary part herein.

According to a qualifying feature of the invention, the improved system comprises only one feeding circuit assembly and selective control of the compressed air (or other fluid) to obtain the lowering of the blades or creasers, as well as the lock and release of the cutting or creasing assembly. The lock or "self-braking" and the lowering of the blades or creasers are therefore obtained characteristically through only one piping (understood in its fullest meaning) for the compressed fluid, and the system can also be adapted to operate in depression conditions. The action, previously called "self-locking" (expression now repeated for coherence), is effected in particular advantageous conditions of synchronism with the lowering action of the blades or creasers. Especially, locking occurs at the instant in which said lowering happens, whereas all the assemblies are released at the beginning of the re-lifting of the blades or creasers. This synchronism itself is guaranteed by the unification of the lock pneumatic circuit systems and, respectively, of the blades' or creasers' movement.

Moreover, from this unique piping, through a self-regulation small valve, originates a first pipe feeding the pneumatic assembly elastically opposed for the lowering of the blade or creaser and a second pipe feeding a lock chamber, in which works an actuator piston which carries out the lock.

This system is completed with favourably gauged holes for the air passing to the lock chamber, for the correct proportion of the pneumatic actions to the aims of synchronism. Obviously, the above is extended, in the limits of the compatibilities, to the field of the counterblade rests, co-operating with said blades, or of the creasers replacing and/or completing the cutting actions.

Figure 2:
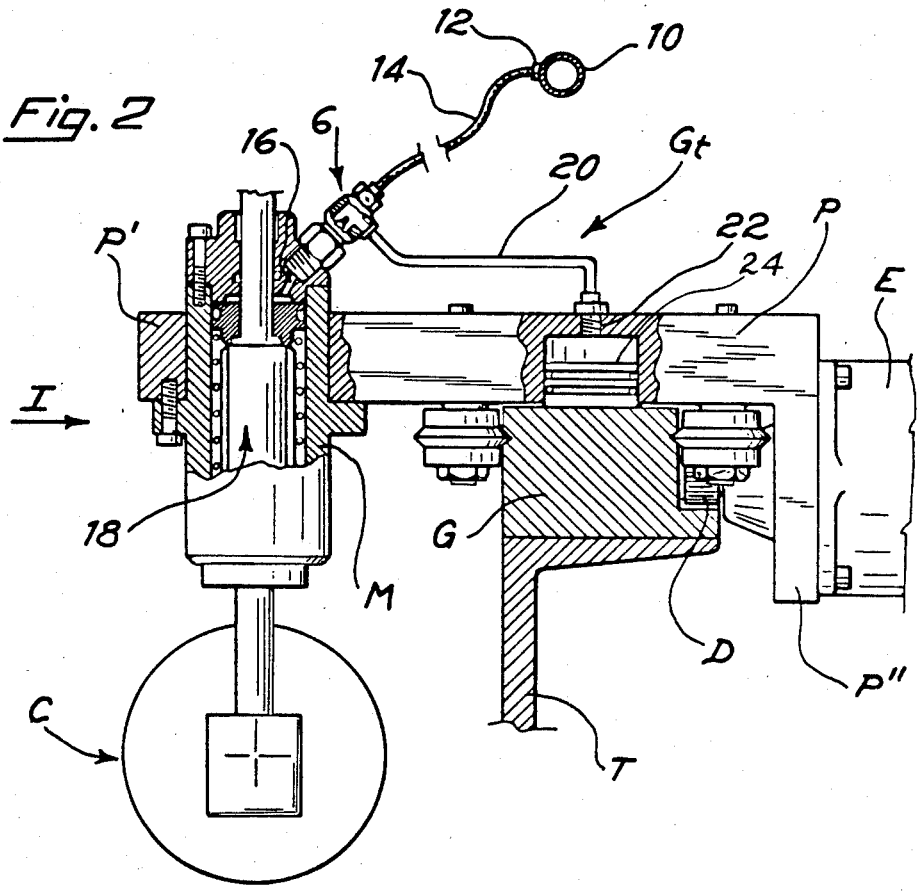

These and other features of the invention will be now described with reference to a favourite form of realization of same, illustrated as an example in the herewith enclosed drawings, in which:

FIG. 1 represents fragmentarily and on a reduced scale, and with some structural simplifications, a part of a system, structurally and operatively associated with several cutting assemblies borne by a beam with guide, to illustrate positional variations, selectively selectable and controllable, this system being reproduced in front view in direction indicated with I in FIG. 2, in which some principal components of the system and of any cutting assembly are reproduced partially in view and partially in section from the plan indicated with II—II in FIG. 1, indifferently from the direction in which the system is observed.

To simplify, only assemblies comprising blades have been reproduced, i.e. excluding the reproduction of the eventual counterblades as well as creasing assemblies, or other means, mechanisms and/or devices known in themselves, and of eventual interest to the aims of the realization and operation of the system and concerned assemblies or its equivalent. In the drawings and particularly in FIG. 2, the present invention is illustrated according to an embodiment comprising a plate or rest P having an "L" shape. This plate P comprises a longer arm P' (FIG. 2) in which is pitched and fixed the hub M of the actuator elastically returned for lowering and lifting the corresponding blade C, and a second arm P'' bearing a motor, generally electrical E, which operates a toothed pinion which engages itself on a rack D toothing of which belongs to the guide G adjacent and borne on the beam T (observe FIG. 1 for the whole view and other indications). Suppose having selected the relative position of at least a part of the cutting assemblies Gt at a distance L, but obviously this positioning along the beam T can be different depending on the width of the strips of the laminar material to be cut.

Therefore, said length L can be selectively varied to select different intervals I, starting the motor E of the respective assembly, obviously remotely controlled and exploiting suitable known systems of programming. The pneumatic means present in the concerned system are started characteristically through only one feeding line, schematically indicated with La and materialized by a piping or primary pipe 10 in FIG. 2. This pipe 10 is mostly set up parallel with the beam T and, also mostly, comprises a plurality of union offtakes 12 to as many preferably flexible pipings 14 feeding the respective cutting assemblies Gt. These pipings 14 joined with the respective cutting assembly Gt in correspondence with a self-regulation small valve 6.

The improved system, according to the present invention, is characterized by the fact that it comprises, in said structural unit Gt, first circuit means for feeding in 16 the actuator 18 for lowering the blade C and second circuit means 20 for feeding in 22 a piston 24 operating in a chamber formed in the plate P which constitutes in its turn the actuator of the lock and, respectively, of the release. From this above, it is evident that setting in the unique feeding line La, i.e. in the piping 10, a pneumatic signal (pressure or depression), all the actuators 18 and all the lock pistons 24 are synchronously started and respectively stopped, at reversal of the pressure application sense or, respectively, depression, that is of the pneumatic An important phase condition is identified, according to the invention, with the fact that the lock occurs while the blades C are lowered, the also important condition of synchronism results from the fact that, setting a pneumatic pressure in the line La, i.e. in the primary piping 10, this pressure is applied simultaneously in each piping offtake 14, the differences in time eventually resulting from eventual differences in the pneumatic resistance in said piping off-takes being negligible and practically unnoticeable, obviously in good integrity and work conditions of the different pipings, unions and means belonging to the circuit system. The action of the pistons 24, with respect to the guide G, is identified with a braking action, which is concluded practically with the lock at the end of said action.

These braking or locking actions being suspended, the different cutting assemblies Gt would result theoretically free to move, but they practically remain motionless due to the own inertia of said assemblies and, above all, of the electrical motors E which, obviously, are stopped during the work phase of the blades C and anyway during the running of the system.

To complete and integrate the synchronism and phase conditions, these electrical motors can be provided with their own self-locking means, for instance electrical. The improvement can be consequently completed with complementary systems of interlocking. identification and control of the distances L and/or of the intervals I and others, like styluses or positioning contactors or similar means.

Since, however, the improvement to the lock and/or release systems, according to the invention, has been described and illustrated only as an example and to the only purpose of demonstrating its feasibility and at least some of the main industrial advantages which can be obtained from the invention itself, it is evident that the improvement to said systems can undergo many modifications and be concretely realized in combination with other additional and/or equivalent technical means and solutions resulting from the practical and long experience, everything without leaving the limits of the present industrial patent-right, particularly as defined in one or any of the claims which follow.

I claim:

1. In a lock and/or release system, structurally and operatively associated with the rests of circular blades or creasers, for cutting or creasing machines used in paper and cardboard manufacturing, comprising a plurality of structural operative units each having at least a rest cooperating with means for sliding and for traverse, a bearing beam, guides for the traverse of each unit along said bearing beam, said means for sliding cooperating with said guides, each unit including at least a circular blade or creaser, lowering and lifting means for the circular blade or creaser, and means for selectively locking or releasing said rest on said beam, the improvement comprising means for synchronizing the lowering and lifting means for the circular blade or creaser and the means for selectively locking or releasing said rest on said beam so that simultaneously with the lowering of said circular blade or creaser said rest locks with respect to said beam and simultaneously with the raising of said circular blade or creaser said rest releases with respect to said beam.

2. The lock and/or release system as defined in claim 1, wherein the means for selectively locking or releasing said rest on said beam includes a piston carried by said rest which operatively engages with said beam to lock said rest on said beam and disengages from said beam to release said rest from said beam.

3. The lock and/or release system as defined in claim 2, wherein the lowering and lifting means for the circular blade or creaser and the means for selectively locking or releasing said rest on said beam are operated by means of pressurized fluid.

4. The lock and/or release system as defined in claim 3, wherein said pressurized fluid is fed in a single circuit assembly.

5. The lock and/or release system as defined in claim 4, wherein said pressurized fluid is compressed air.

6. The lock and/or release system as defined in claim 4, wherein said single circuit assembly for said pressurized fluid comprises a primary feed line and a plurality of offtake pipes feeding each cutting or creasing unit.

7. The lock and/or release system as defined in claim 6, wherein said offtake pipes are flexible so as to permit respective movements of said units along the beam.

8. The lock and/or release system as defined in claim 6, wherein each offtake pipe is subdivided into a first passage feeding said lowering and lifting means for the circular blade or creaser and into a second passage feeding said piston for operating said lock or release of said rest on said beam.

9. The lock and/or release system as defined in claim 8, wherein the subdivision of said offtake pipe into said first passage and said second passage occurs at a self-regulation small valve.

10. The lock and/or release system as defined in claim 9, wherein said self-regulation small valve is structurally fixed with the cutting or creasing unit.

11. The lock and/or release system as defined in claim 8, wherein said lock or release piston carried by said rest operates in a piston chamber formed in said rest.

12. The lock and/or release system as defined in claim 11, which further comprises an electrical motor for moving and positioning said structural operative unit along said beam.

13. The lock and/or release system as defined in claim 12, wherein said electrical motor is fixed to said unit and includes a pinion which engages a rack integral with said guides for the traverse of each such unit along the bearing beam.

14. The lock and/or release system as defined in claim 13, wherein the second passage feeding said lock and release piston includes a short essentially stiff pipe fixed with respect to the rest of said unit.

15. The lock and/or release system as defined in claim 14, wherein said second passage feeding said lock and release piston is gauged for the passage of pressurized fluid to result in synchronization between the lock and release of the piston and the lowering and lifting of the circular blade or creaser.

* * * * *